US009822561B2

(12) United States Patent
Chiang et al.

(10) Patent No.: US 9,822,561 B2
(45) Date of Patent: Nov. 21, 2017

(54) FIXING APPARATUS AND COMPUTER APPARATUS USING THE SAME

(71) Applicant: PEGATRON CORPORATION, Taipei (TW)

(72) Inventors: Chih-Liang Chiang, Taipei (TW); Ming-Sen Wu, Taipei (TW); Chen-Yi Liao, Taipei (TW); Yen-Chih Kuo, Taipei (TW)

(73) Assignee: Pegatron Corporation, Taipei (TW)

( * ) Notice: Subject to any disclaimer, the term of this patent is extended or adjusted under 35 U.S.C. 154(b) by 342 days.

(21) Appl. No.: 14/688,504

(22) Filed: Apr. 16, 2015

(65) Prior Publication Data

US 2015/0345193 A1 Dec. 3, 2015

(30) Foreign Application Priority Data

May 30, 2014 (TW) ..... 103119135 A

(51) Int. Cl.
*E05C 1/08* (2006.01)
*E05C 19/06* (2006.01)
*E05C 1/00* (2006.01)

(52) U.S. Cl.
CPC ..... *E05C 19/06* (2013.01); *Y10T 292/097* (2015.04); *Y10T 292/0934* (2015.04); *Y10T 292/0969* (2015.04); *Y10T 292/0995* (2015.04)

(58) Field of Classification Search
CPC ..... Y10T 292/0969; Y10T 292/097; Y10T 292/0977; Y10T 292/0995
USPC ..... 292/137, 163; 361/679.58
See application file for complete search history.

(56) References Cited

U.S. PATENT DOCUMENTS 6,134,116 A * 10/2000 Hoss ..... E05C 1/10 292/146
6,554,327 B1 * 4/2003 Riley ..... E05C 1/04 220/326
6,870,740 B2 * 3/2005 Hsu ..... G06F 1/1679 361/679.43
7,088,588 B2 * 8/2006 Lee ..... G06F 1/1616 292/108

(Continued)

FOREIGN PATENT DOCUMENTS

TW 200703749 A 1/2007

*Primary Examiner* — Carlos Lugo
(74) *Attorney, Agent, or Firm* — Muncy, Geissler, Olds & Lowe, P.C.

(57) ABSTRACT

A fixing apparatus comprises a base, a locking structure, an operating member, a first elastic member and a second elastic member. The base has an opening. The locking structure is movably disposed at the opening along a second direction. The operating member is movably disposed at the second surface along a first direction perpendicular to the second direction. The first elastic member is connected with the operating member and the base. The second elastic member is connected with the locking structure and the base. When the operating member moves along the first direction and compresses the first elastic member, the locking structure moves along the second direction by a resilient force of the second elastic member and exposes the opening. When the operating member moves along an opposite direction of the first direction, the locking structure moves along an opposite direction of the second direction and covers the opening.

8 Claims, 5 Drawing Sheets

(56) References Cited

U.S. PATENT DOCUMENTS

| | | | | |
|---|---|---|---|---|
| 7,410,194 | B2 * | 8/2008 | Chen | E05C 1/14 292/37 |
| 7,441,813 | B2 * | 10/2008 | Qin | H04B 1/3883 292/163 |
| 7,543,862 | B2 * | 6/2009 | Lin | E05C 19/06 292/137 |
| 7,609,514 | B2 * | 10/2009 | Doczy | G06F 1/1616 312/223.1 |
| 7,665,774 | B2 * | 2/2010 | Kumagai | G06F 1/1656 292/106 |
| 7,727,666 | B2 * | 6/2010 | Liu | H01M 2/1022 292/170 |
| 7,740,290 | B2 * | 6/2010 | Lo | G06F 1/1616 292/137 |
| 7,751,187 | B2 * | 7/2010 | Wang | E05B 65/006 292/8 |
| 8,322,760 | B2 * | 12/2012 | Wu | E05B 65/006 292/137 |
| 8,360,485 | B2 * | 1/2013 | Ma | H05K 5/0221 292/137 |
| 8,947,877 | B2 * | 2/2015 | Wang | G06F 1/1626 312/223.1 |
| 2005/0168924 | A1 * | 8/2005 | Wu | G06F 1/1616 361/679.58 |
| 2005/0225933 | A1 * | 10/2005 | Kang | H01M 2/1066 361/679.55 |
| 2009/0168340 | A1 * | 7/2009 | Tang | G06F 1/1616 361/679.58 |
| 2009/0323291 | A1 * | 12/2009 | Dong | E05C 19/06 361/726 |

* cited by examiner

FIXING APPARATUS AND COMPUTER APPARATUS USING THE SAME

CROSS-REFERENCE TO RELATED APPLICATIONS

This Non-provisional application claims priority under 35 U.S.C. §119(a) on Patent Application No(s). 103119135 filed in May 30, 2014, the entire contents of which are hereby incorporated by reference.

BACKGROUND

Field of the Invention

This invention relates to a fixing apparatus and a computer apparatus using the same and, more particularly, to a fixing apparatus and a computer apparatus using the same for fixing a portable electronic device.

Description of the Related Art

As the development of electronic technology, many consumer electronic products, such as notebook, portable player, portable game console, personal digital assistant, electronic dictionary, cellphone, are all toward to smaller size in order to help the user carried easily and used any time anywhere.

Taking a tablet computer as an example, many additional devices for the tablet computer have been invented recently, such as a protective cover or a wireless keyboard of the tablet computer in order to expend or assist the functions of the tablet computer. In order to reduce the space for receiving, the electronic products may use a hinge for closing or opening a display panel with respect to the additional devices.

For the function mentioned above, the recent tablet computer is mostly fixed with the additional devices firmly by using a magnet or a protruding interfering structure. Using the magnet for fixing always have some disadvantages, such as unstable fixed or demagnetized other magnet devices. If the hook is applied, no matter the additional device or the table computer will have some holes formed thereon in order to receive the hook and the route of the hook thus to destroy the appearance of the additional device and the table computer.

For this reason, how to offer a fixing apparatus and a computer apparatus using the same, which can apply the novel structure to reduce the destruction of the appearance of the apparatus and offer a stable fixing function, is one of the most important lesson.

BRIEF SUMMARY

According to the abovementioned lesson, an aspect of the present invention is to provide a fixing apparatus and a computer apparatus using the same to utilize the novel structure thereof to reduce the destruction of the appearance of the apparatus and offer a stable fixing function.

To achieve the abovementioned purpose, a fixing apparatus disclosed according to the present invention is provided for fixing a portable electronic device. The fixing apparatus comprises a base, a locking structure, an operating member, a first elastic member and a second elastic member. The base has a first surface and a second surface adjacent to each other and an opening, in which the opening passes through the first surface and the second surface. The locking structure is movably disposed at the opening along a second direction for locking the portable electronic device. The operating member is movably disposed at the second surface along a first direction and abuts against the locking structure for restricting the locking structure to move toward the second direction, in which the first direction is perpendicular to the second direction. The first elastic member is connected with the operating member and the base. The second elastic member is connected with the locking structure and the base and has a resilient force, in which the resilient force is capable of pushing the locking structure to move toward the second direction. When the operating member moves along the first direction and compresses the first elastic member, the locking structure moves along the second direction by the resilient force of the second elastic member and exposes the opening. When the operating member is released and moves along an opposite direction of the first direction, the locking structure moves along an opposite direction of the second direction and covers the opening so as to locking the portable electronic device.

To achieve the abovementioned purpose, a computer apparatus disclosed according to the present invention comprises a portable electronic device and a fixing apparatus. The fixing apparatus comprises a base, a locking structure, an operating member, a first elastic member and a second elastic member. The base has a first surface and a second surface adjacent to each other and an opening, in which the opening passes through the first surface and the second surface. The locking structure is movably disposed at the opening along a second direction for locking the portable electronic device. The operating member is movably disposed at the second surface along a first direction and abuts against the locking structure for restricting the locking structure to move toward the second direction, in which the first direction is perpendicular to the second direction. The first elastic member is connected with the operating member and the base. The second elastic member is connected with the locking structure and the base and has a resilient force, in which the resilient force is capable of pushing the locking structure to move toward the second direction. When the operating member moves along the first direction and compresses the first elastic member, the locking structure moves along the second direction by the resilient force of the second elastic member and exposes the opening. When the operating member is released and moves along an opposite direction of the first direction, the locking structure moves along an opposite direction of the second direction and covers the opening so as to locking the portable electronic device.

In an embodiment, the fixing apparatus further comprises an engaging member. The engaging member is disposed at the portable electronic device. A margin of the engaging member is provided with a first engaging structure.

In an embodiment, the locking structure has an engaging portion and the engaging portion is detachably engaged with the first engaging structure.

In an embodiment, the fixing apparatus further comprises a restraining member. The restraining member is disposed at one end of the base for connecting with the first engaging structure of the engaging member to allow the portable electronic device and the base to close with each other.

In an embodiment, the second direction is a normal direction of the first surface.

Accordingly, the fixing apparatus and the computer apparatus using the same provided in the present invention comprise a locking structure, an opening and an operating member. The operating member is capable of moving in the first direction and then linking the locking structure to move together in the second direction through the abutment between the operating member and the locking structure, and furthermore, the included angle between the respective extending directions of the first direction and the second direction is 90 degrees. The novel design of the fixing apparatus of the present invention allows the locking structure of the present invention to cover the opening during the moving process so as to prevent the entrance of the dust and have the effect of beatifying the appearance.

DETAILED DESCRIPTION

Hereinafter, a fixing apparatus and a computer apparatus using the same according to a preferred embodiment of the present invention will be illustrated with reference to the relevant drawings, in which the same elements will be described by the same reference symbols.

Figure 1:
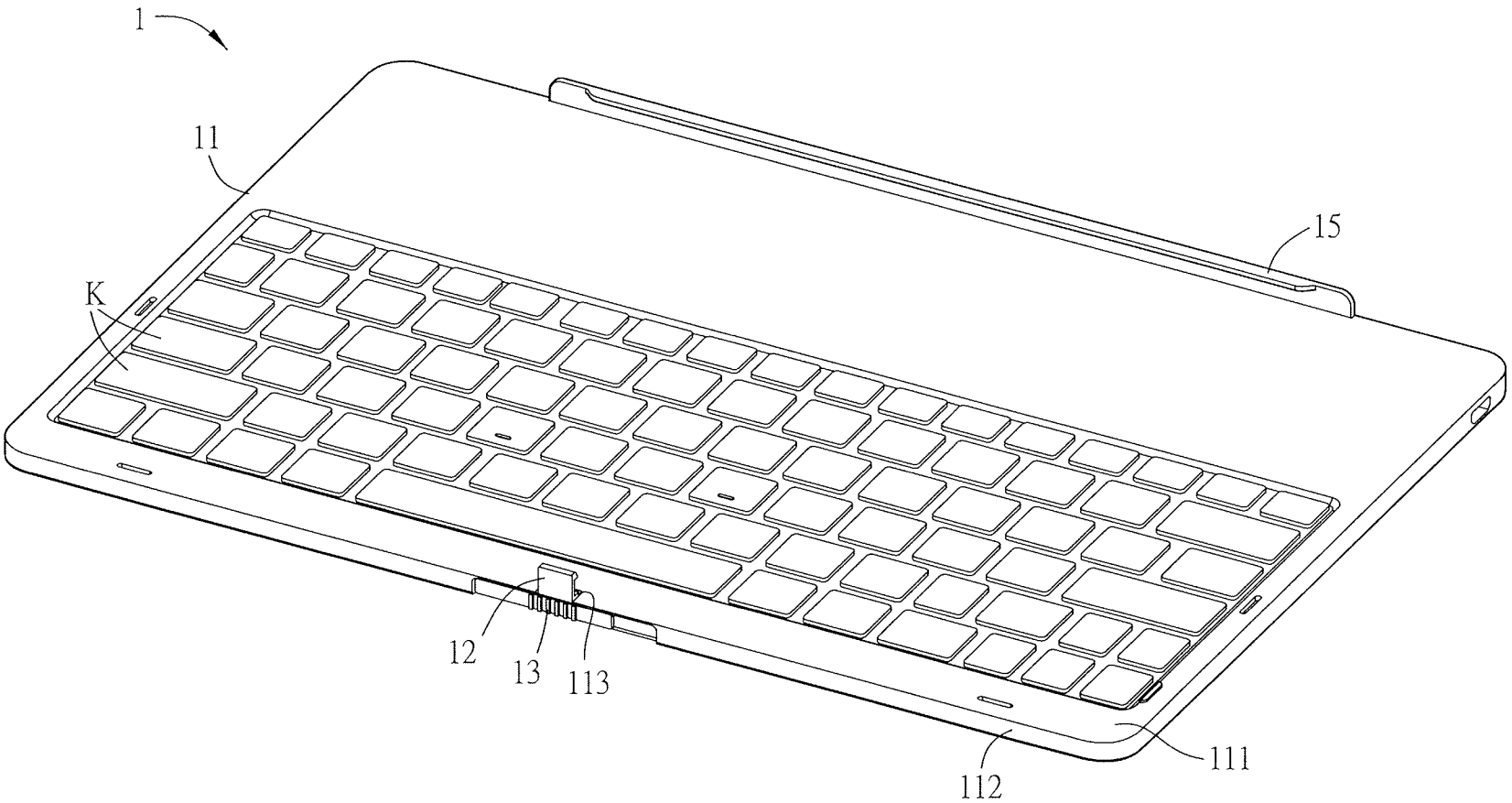
FIG. 1 is a schematic drawing showing an appearance of a fixing apparatus according to a preferred embodiment of the present invention.

Please refer to FIG. 1. FIG. 1 is a schematic drawing showing an appearance of a fixing apparatus 1 according to a preferred embodiment of the present invention, in which the fixing apparatus 1 is provided for fixing or receiving a portable electronic device, such as a smart phone, a tablet, a digital player, an electronic book or an electronic photo frame and so on. First, the detailed structure of the fixing apparatus 1 will be illustrated as follows.

Note that the fixing apparatus 1 takes an external keyboard as an example in the present embodiment. However, it is not limited thereto. In practical, the fixing apparatus 1 can be other external apparatuses capable of being cooperated with the portable electronic device, such as a protective cover.

The fixing apparatus 1 comprises a base 11, a locking structure 12, an operating member 13, a first elastic member 141 and a second elastic member 142. In the present embodiment, the base 11 comprises at lease one key and the key can be a physical key or a virtual key. In the present embodiment, the base 11 has a plurality of keys K for example. In practical, the base 11 further comprises a plurality of connecting ports (not shown in the figure) for connecting with other members or apparatuses. In addition, the base 11 further comprises a power socket and a rechargeable battery (not shown in the figure). A user is able to utilize mains electricity through the power socket, or recharge the rechargeable battery through the power socket for being utilized by the fixing apparatus 1.

Figure 2A:
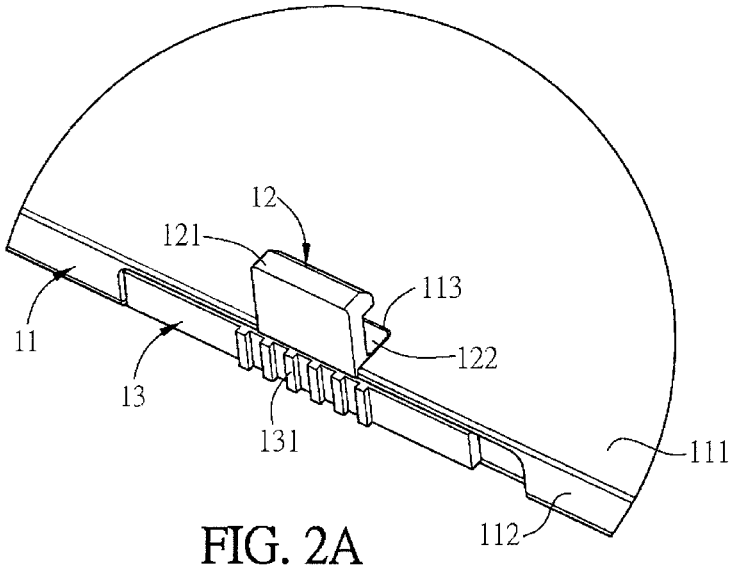
FIG. 2A is an enlarged schematic view of a locking structure of the fixing apparatus shown in FIG. 1.
Figure 2B:
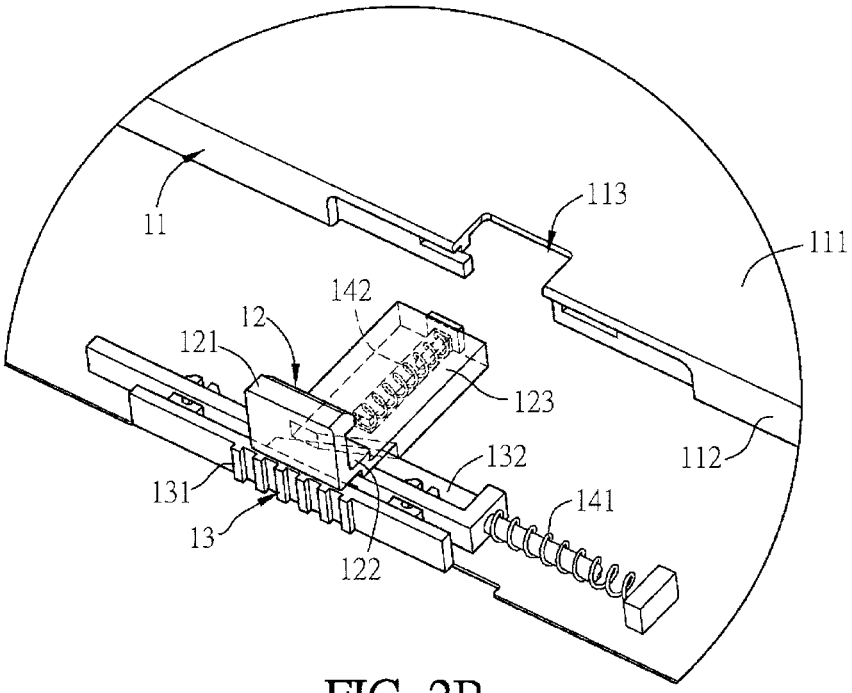
FIG. 2B is a partially exploded schematic view of the fixing apparatus shown in FIG. 2A.

FIG. 2A is an enlarged schematic view of a locking structure of the fixing apparatus shown in FIG. 1. FIG. 2B is a partially exploded schematic view of the fixing apparatus shown in FIG. 2A. Please simultaneously refer to FIGS. 1 to 2B. The base 11 has a first surface 111 and a second surface 112. The first surface 111 and the second surface 112 are two adjacent surfaces, and the first surface of the present embodiment is a plane disposed with a plurality of keys K. The base 11 has an opening 113, and the opening 113 passes through the first surface 111 and the second surface 112. The opening 113 is provided for receiving the locking structure 12. Thus, the amount or the size of the opening 113 will cooperate with the amount and the size of the locking structure 12.

FIG. 2A and FIG. 2B show a closed state of the locking structure 12. To clearly describe the detailed structure of the fixing apparatus of the present embodiment, an upper cover (namely the second surface 112) is separated from the base 11 for showing the detailed structure and the acting method of the locking structure 12 and the base 11. The locking structure 12 has an engaging portion 121 and a covering portion 122. The locking structure 12 is able to be movably disposed at the opening 113 along a second direction D2 for locking the portable electronic device 2. More particularly, the locking structure 12 utilizes the covering portion 122 to engage with and dispose at the opening 113. The locking structure 12 further comprises an extending portion 123 extended from the covering portion 122. On the whole, the extending portion 123 is not exposed out of the base 11 when it is already assembled as shown in FIG. 2A.

Please simultaneously refer to FIGS. 1 to 2B, the operating member 13 is able to be movably disposed at the second surface 112 along a first direction D1 for restricting the locking structure 12 to move toward the second direction D2. The operating member 13 has an operating unit 131 and an abutting portion 132 abutted against the locking structure 12. More particularly, the abutting portion 132 and the extending portion 123 abut with each other so as to allow the two portions to slide or move with slightly friction relative to one another.

In addition, two ends of the first elastic member 141 are connected, respectively, with the abutting portion 132 of the operating member 13 and the base 11. Two ends of the second elastic member 142 are connected, respectively, with the extending portion 123 of the locking structure 12 and the base 11. The first elastic member 141 and the second elastic member 142 both have resilient force. That is, when the abutting portion 132 of the operating member 13 moves, it is able to move with the first elastic member 141 and affected by the resilient force thereof. Similarly, when the extending portion 123 of the locking structure 12 moves, it is able to move with the second elastic member 142 and affected by the resilient force thereof.

Figure 3A:
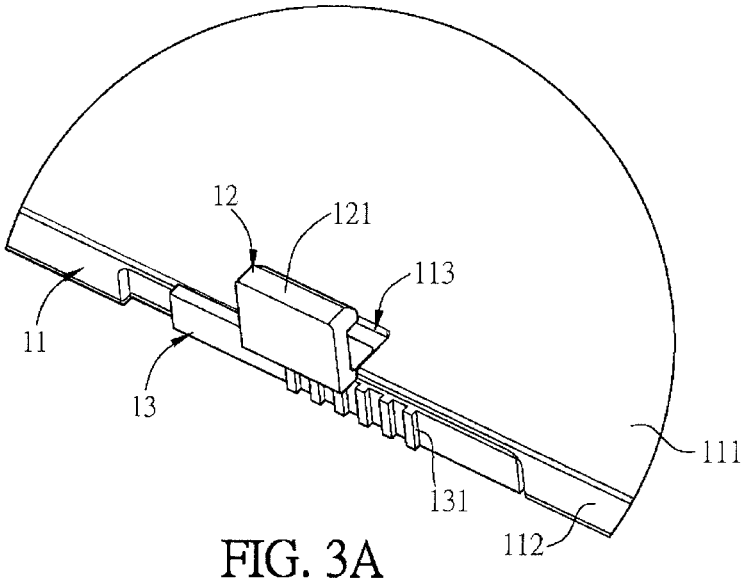
FIG. 3A is an enlarged operation schematic view of a locking structure of the fixing apparatus shown in FIG. 1.
Figure 3B:
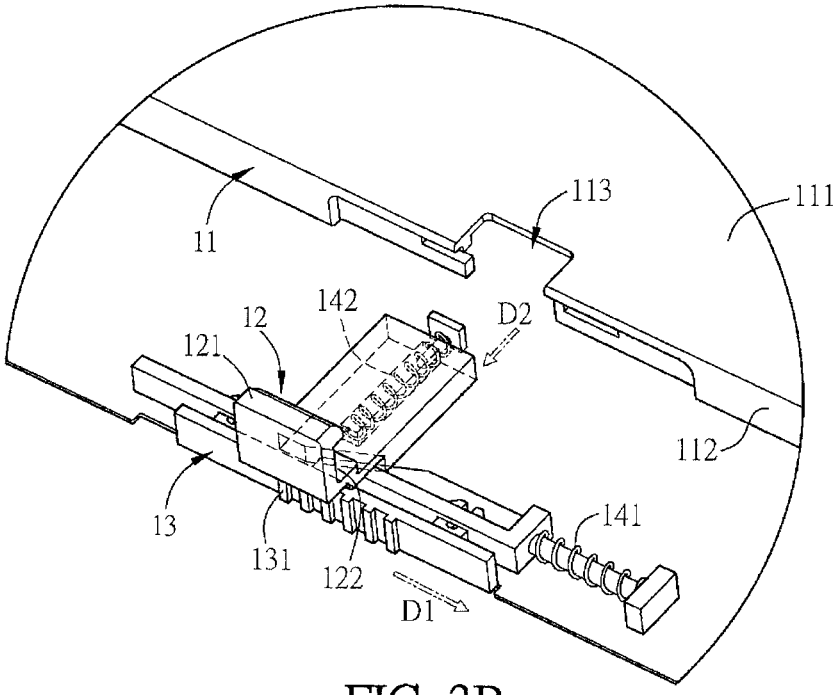
FIG. 3B is a partially exploded schematic view of the fixing apparatus shown in FIG. 3A.

As to the detailed acting method of the fixing apparatus 1, please refer to FIGS. 2A to 3B. FIG. 3A is an enlarged operation schematic view of a locking structure of the fixing apparatus shown in FIG. 1, and FIG. 3B is a partially exploded schematic view of the fixing apparatus shown in FIG. 3A. More particularly, the first elastic member 141 is at an original state (that is, the state that is not compressed) when the locking structure 12 is at the closed state (as shown in FIG. 2A and FIG. 2B). Under such the state, an inclined plane of the extending portion 123 is completely stopped by an inclined plane of the abutting portion 132 so as to allow the second elastic member 142 to be at a compressed state. In the meanwhile, the covering portion 122 covers the opening 113 so as to prevent dust or dirty impurities from entering the base 11 for extending the lifetime.

The user can operate as shown in FIG. 3A and FIG. 3B to allow the operating member 131 to move along the first direction D1 by pushing the operating unit 131 when it needs to use the fixing apparatus 1 for fixing a portable electronic device. When the operating member 13 moves toward the first direction D1, the abutting portion 132 also moves toward the first direction D1 at the same time so as to compress the first elastic member 141. When the abutting portion 132 also moves toward the first direction D1 at the same time, the inclined plane of the extending portion 123 is no longer completely stopped by the inclined plane of the abutting portion 132 to allow the locking structure 12 to move toward the second direction D2. More particularly, the extending portion 123 of the locking structure 12 pushes the locking structure 12 to move along the second direction D2 and expose the opening 113 by the resilient force released from the second elastic member 142 that is originally compressed. Note that, under such the situation, the inclined plane of the extending portion 123 still partially abuts against the inclined plane of the abutting portion 132. At this time, the fixing apparatus 1 is at a state capable of being disposed with the portable electronic device. As to the way of disposing the portable electronic device, it will be described as follows.

When the user wants the fixing apparatus 1 to be back to the closed state, the operating member 131 is released to allow the operating member 131 to move along an opposite direction of the first direction D1 by the resilient force of the first elastic member 141. It needs to say that the resilient force of the first elastic member 141 is larger than that of the second elastic member 142. Therefore, the abutting portion 132 also moves toward the opposite direction of the first direction D1 when the operating member 13 moves toward the opposite direction of the first direction D1. And then, due to its larger resilient force, the abutting portion 132 compresses and pushes the extending portion 123 to move along an opposite direction of the second direction D2 and cover the opening 113 when it abuts against the extending portion 123 so as to allow the locking structure 12 to go back to the closed state. In the meanwhile, the second elastic member 142 also goes back to the compressed state. At that time, the locking structure 12 is capable of locking the portable electronic device 2.

In the present embodiment, the first direction D1 is perpendicular to the second direction D2. That is, an included angle between the respective extending directions of the first direction D1 and the second direction D2 is 90 degrees and the second direction D2 is a normal direction of the first surface 111.

Figure 4A:
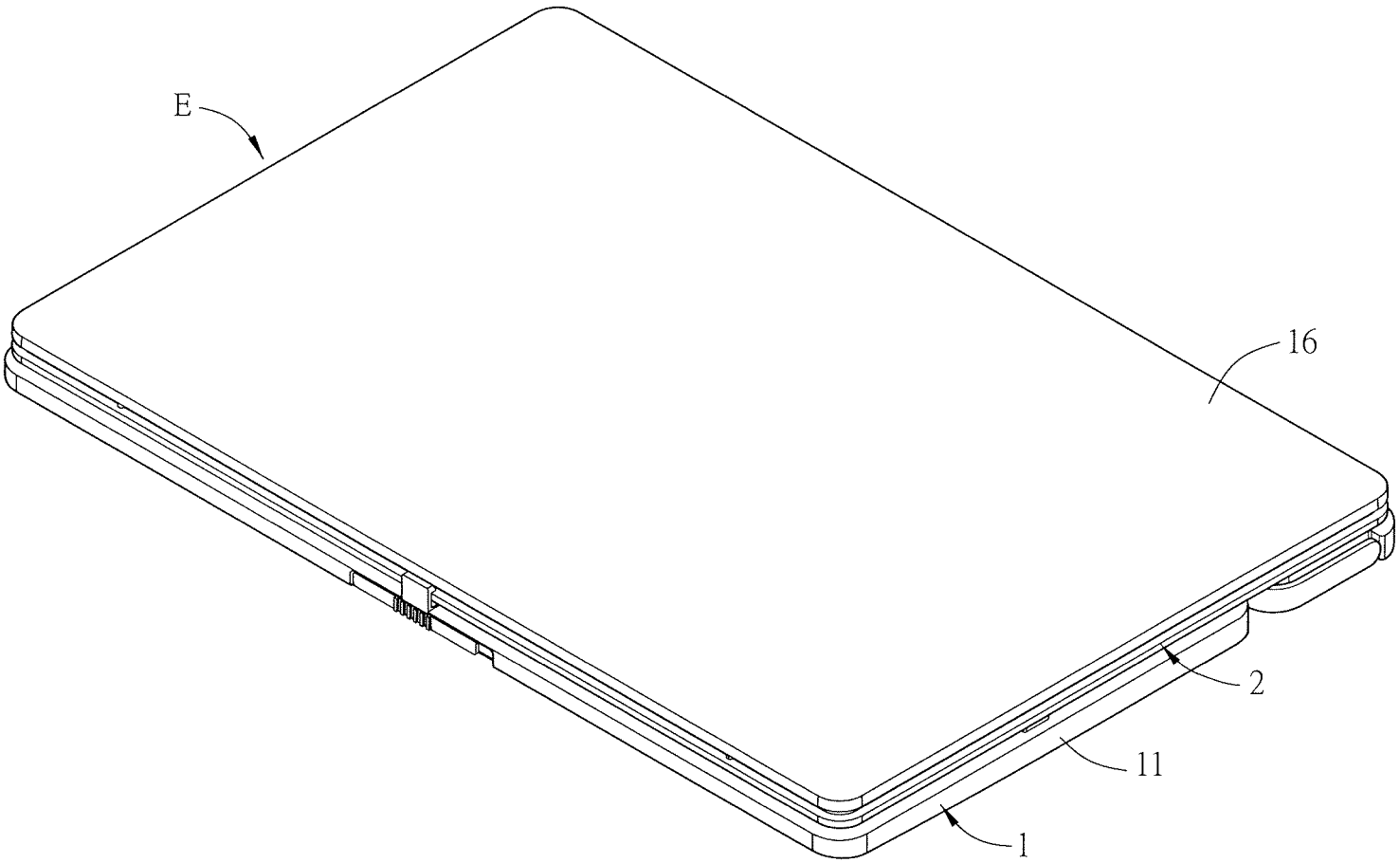
FIG. 4A is a schematic drawing showing an appearance of a computer apparatus using the fixing apparatus of FIG. 1.
Figure 4B:
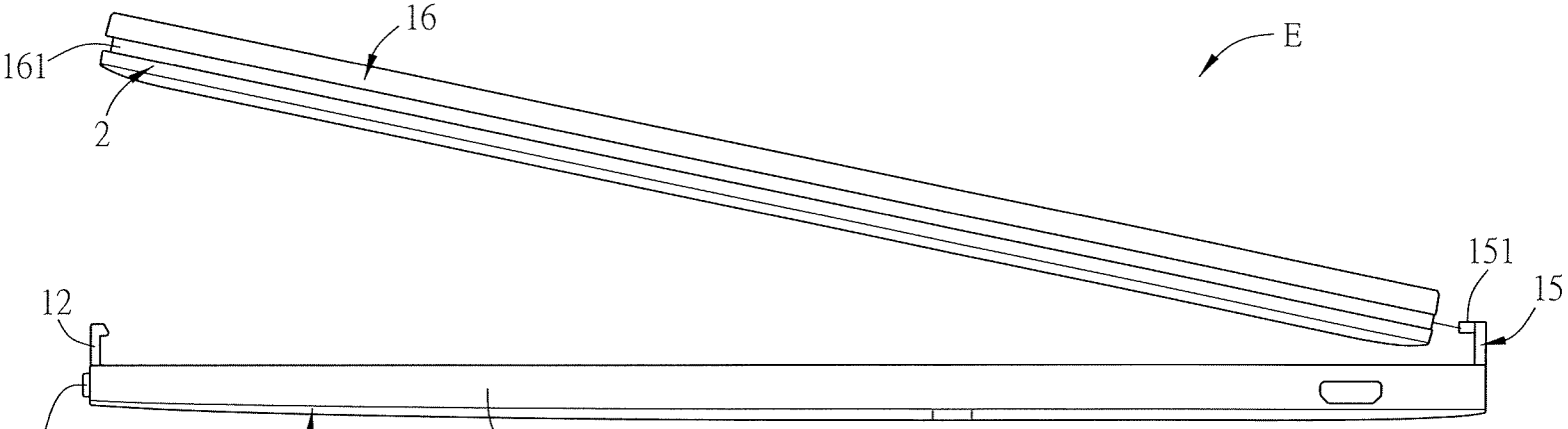
FIG. 4B is a lateral view showing a receiving state of the computer apparatus shown in FIG. 4A.
Figure 4C:
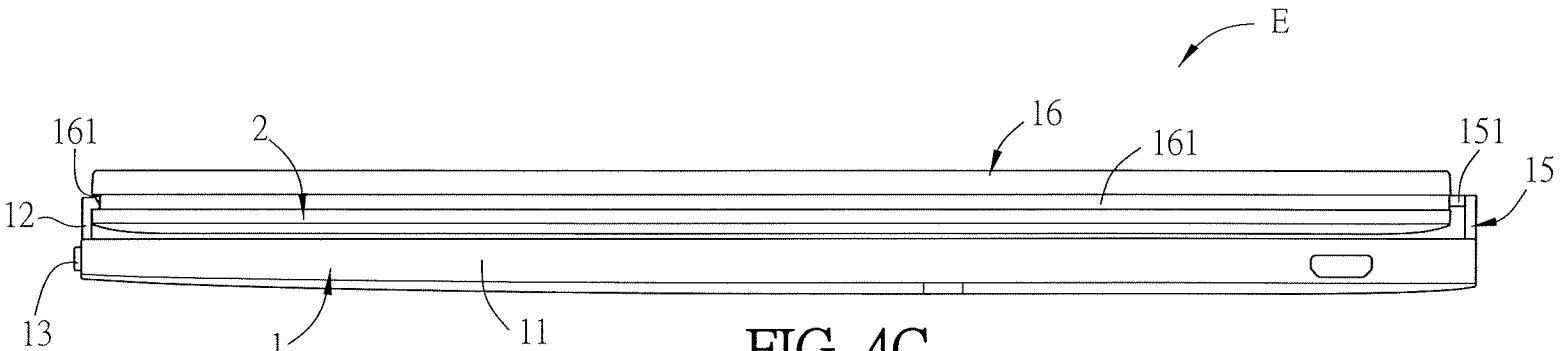
FIG. 4C is a lateral view showing a receiving state of the computer apparatus shown in FIG. 4A.

The present invention further provides a computer apparatus E using the fixing apparatus 1. Please refer to FIGS. 4A to 4C, the fixing is achieved by engaging the locking structure 12 of the fixing apparatus 1 with the portable electronic device E that is used in cooperation with an engaging member 16. More particularly, the fixing apparatus 1 further has an engaging member 16. The engaging member 16 is disposed at the portable electronic device 2 and a margin of the engaging member 16 is provided with a first engaging structure 161. Because the locking structure 12 is provided with an engaging portion 121, the portable electronic device 2 (and the engaging member 16) is detachably combined with the engaging portion 121 of the locking structure 12 through the first engaging structure 161. In the present embodiment, the first engaging structure 161 of the engaging member 16 is a groove disposed at the margin of the engaging member 16 and the engaging portion 121 of the locking structure 12 is a projection structure disposed at the inner side of the locking structure 12. The portable electronic device 2 can be firmly fixed at the locking structure 12 through the engagement between the first engaging structure 161 and the engaging portion 121.

The portable electronic device 2 can be fixed or clipped effectively by the abovementioned fixing apparatus 1. Furthermore, the material of the first engaging structure 161 and the engaging portion 121 of the present embodiment both have a certain degree of elasticity so that the above two can engage with each other in substantially the same size through extrusion.

Comparing to the prior fixing apparatus, no matter the fixing apparatus itself or the cooperated portable electronic device both have some holes formed thereon when the hook is applied for fixing in order to receive the hook and the route of the hook. Thus the appearance of the additional device and the table computer is destroyed. The fixing apparatus of the present embodiment adjusts an acting direction of the hook from a transverse movement, which is parallel to the first direction D1, to a vertical movement along the second direction D2, extends the opening 113 to pass through the first surface 111 and the second surface 112 and then utilizes the covering portion 122 of the locking structure 12 to cover the opening 113 for preventing the entrance of the dust and having the effect of beautifying the appearance.

In addition, the fixing apparatus 1 of the present embodiment can further apply the same surface treatment on the opening 113 and the first surface 111 to allow the fixing apparatus 1 and the computer apparatus E to have more beautiful appearances. More preferably, by means of the identical surface treatment, the beautiful appearance will not be affected even though the opening 113 will be temporarily exposed during the moving process of the locking structure 12.

In addition, please also refer to FIG. 1 and FIGS. 4A to 4C. The fixing apparatus 1 further comprises a restraining member 15 to allow the computer apparatus E having complete receiving and fixing effects. The restraining member 15 is disposed at one end of the base 11 and also has a second engaging structure 151 corresponding to the first engaging structure 161. In the present embodiment, the second engaging structure 151 has a projection structure which is also shown in the engaging portion 121. The receiving method thereof is capable of referring to FIG. 4B to allow the portable electronic device 2 (and the engaging member 16) to use the first engaging structure 161 to engage with the second engaging structure 151. When the engagement is completed, the state is shown as FIG. 4C and FIG. 4A.

By way of the assistance of the restraining member 15 and the fixedness of the locking structure 12, the fixing apparatus 1 of the present invention enhances the fixing function of the portable electronic device 2 to reduce the volume when the above two are combined to be the computer apparatus E for the user to carry conveniently.

To sum up, the fixing apparatus and the computer using the same provided in the present invention has a locking structure, an opening and an operating member. The operating member is capable of moving in the first direction and then linking the locking structure to move together in the second direction through the abutment between the operating member and the locking structure, and furthermore, the included angle between the respective extending directions of the first direction and the second direction is 90 degrees. Comparing to the prior art, which the moving directions of the locking structure and the operating member are parallel and the opening is always exposed under every kind of operating states of the locking structure, the novel design of the fixing apparatus of the present invention allows the locking structure of the present invention to cover the opening during the moving process so as to prevent the entrance of the dust and have the effect of beatifying the appearance.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A fixing apparatus for fixing a portable electronic device, comprising:

a base having a first surface and a second surface adjacent to each other and an opening passing through the first surface and the second surface;

a locking structure movably disposed at the opening along a second direction, the locking structure used for locking the portable electronic device;

an operating member movably disposed at the second surface along a first direction and abutting against the locking structure for restricting the locking structure to move toward the second direction, wherein the first direction is perpendicular to the second direction;

a first elastic member connected with the operating member and the base; and a second elastic member connected with the locking structure and the base and having a resilient force for pushing the locking structure to move toward the second direction;

an engaging member disposed at the portable electronic device, wherein a margin of the engaging member is provided with a first engaging structure, the portable electronic device is detachably combined with the locking structure through the first engaging structure;

wherein the locking structure moves along the second direction by the resilient force of the second elastic member and exposes the opening when the operating member moves along the first direction and compresses the first elastic member, wherein the locking structure moves along an opposite direction of the second direction, covers the opening and locks the portable electronic device when the operating member is released and moves along an opposite direction of the first direction.

2. The fixing apparatus according to claim 1, wherein the locking structure has an engaging portion and the engaging portion is detachably engaged with the first engaging structure.

3. The fixing apparatus according to claim 1 further comprising:

a restraining member disposed at one end of the base for connecting with the first engaging structure of the engaging member to allow the portable electronic device and the base to close with each other.

4. The fixing apparatus according to claim 1, wherein the second direction is a normal direction of the first surface.

5. A computer apparatus, comprising:

a portable electronic device; and a fixing apparatus, comprising:

a base having a first surface and a second surface adjacent to each other and an opening passing through the first surface and the second surface;

a locking structure movably disposed at the opening along a second direction, the locking structure used for locking the portable electronic device;

an operating member movably disposed at the second surface along a first direction and abutting against the locking structure for restricting the locking structure to move toward the second direction, wherein the first direction is perpendicular to the second direction;

a first elastic member connected with the operating member and the base; and a second elastic member connected with the locking structure and the base and having a resilient force for pushing the locking structure to move toward the second direction;

an engaging member disposed at the portable electronic device, wherein a margin of the engaging member is provided with a first engaging structure, the portable electronic device is detachably combined with the locking structure through the first engaging structure;

wherein the locking structure moves along the second direction by the resilient force of the second elastic member and exposes the opening when the operating member moves along the first direction and compresses the first elastic member, wherein the locking structure moves along an opposite direction of the second direction, covers the opening and locks the portable electronic device when the operating member is released and moves along an opposite direction of the first direction.

6. The computer apparatus according to claim 5, wherein the locking structure has an engaging portion and the engaging portion is detachably engaged with the first engaging structure.

7. The computer apparatus according to claim 5, wherein the fixing apparatus further comprises:

a restraining member disposed at one end of the base for connecting with the first engaging structure of the engaging member to allow the portable electronic device and the base to close with each other.

8. The computer apparatus according to claim 5, wherein the second direction is a normal direction of the first surface.

* * * * *